US006140758A

United States Patent [19]

Matsuda et al.

[11] Patent Number: 6,140,758

[45] Date of Patent: Oct. 31, 2000

[54] CATHODE RAY TUBE WITH COLOR FILTER

[75] Inventors: Hidemi Matsuda, Fukaya; Takeo Itou, Kumagaya; Makoto Onodera, Hyogo-ken; Yoshinori Takahashi; Norihisa Nakao, both of Fukaya, all of Japan

[73] Assignee: Kabushiki Kaisha Toshiba, Kawasaki, Japan

[21] Appl. No.: 09/289,645

[22] Filed: Apr. 12, 1999

Related U.S. Application Data

[62] Division of application No. 08/936,516, Sep. 24, 1997, Pat. No. 5,955,226, which is a continuation of application No. 08/577,876, Dec. 22, 1995, abandoned.

[30] Foreign Application Priority Data

Dec. 26, 1994 [JP] Japan ..... 6-322062

[51] Int. Cl.[7] ..... H01J 29/10

[52] U.S. Cl. ..... 313/466; 313/474; 313/112

[58] Field of Search ..... 313/461, 466, 313/473, 474, 112; 430/27, 25, 23

[56] References Cited

U.S. PATENT DOCUMENTS

| | | | |
|---|---|---|---|
| 3,632,339 | 1/1972 | Khan | 430/25 |
| 4,251,610 | 2/1981 | Haven | 430/25 |
| 4,392,077 | 7/1983 | Libman | 313/474 |
| 4,572,880 | 2/1986 | Miura | 430/25 |
| 5,114,494 | 5/1992 | Remec | 134/1 |
| 5,340,673 | 8/1994 | Tateyama | 430/23 |
| 5,700,609 | 12/1997 | Matsuda | 430/27 |

FOREIGN PATENT DOCUMENTS

| | | | |
|---|---|---|---|
| 0 322 200 | 6/1989 | European Pat. Off. . | |
| 0 613 167 | 8/1994 | European Pat. Off. . | |
| 1 139 875 | 11/1962 | Germany | 428/68 |
| 57-4012 | 1/1982 | Japan | 430/7 |
| 61-041102 | 2/1986 | Japan . | |
| 5-275008 | 10/1993 | Japan . | |
| 8-236020 | 9/1996 | Japan | H01J 9/227 |
| 63-085603 | 4/1998 | Japan . | |
| 2 240 213 | 7/1991 | United Kingdom . | |

OTHER PUBLICATIONS

Jaromir Kasar, "Light Sensitive Systems", J. Wiley & Sons, pp. 46–99, Aug. '65.

*Primary Examiner*—Michael H. Day
*Attorney, Agent, or Firm*—Pillsbury Madison & Sutro LLP

[57] ABSTRACT

A display screen having a color filter including a black matrix formed on a substrate of the display screen. A number of color filter layers, each formed in holes of the matrix, provide filtering of light components corresponding to the color of the filter layer. Also provided is one other color filter layer of a final color. This other color filter is also formed on the matrix and formed in another one of the other holes. Consequently, the other color filter layer can be formed without the need of exposing an associated resist layer, thereby simplifying the color filter manufacturing process.

5 Claims, 3 Drawing Sheets

FIG. 1
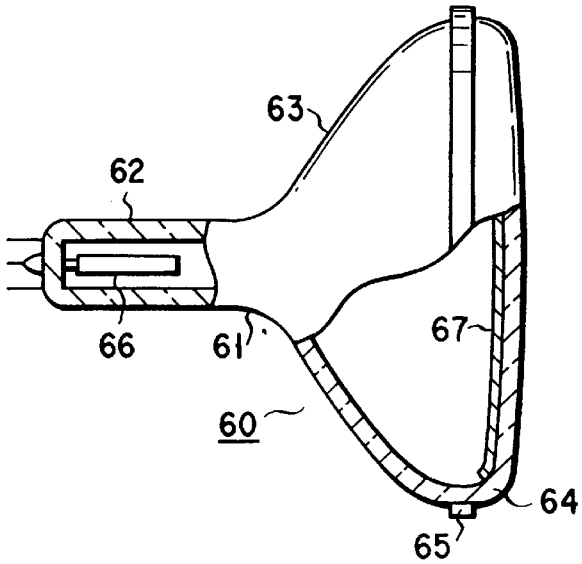
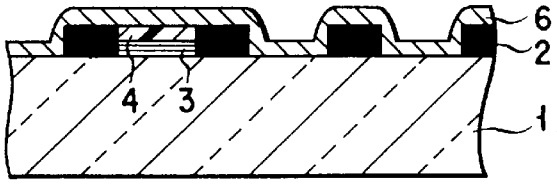
FIG. 3A
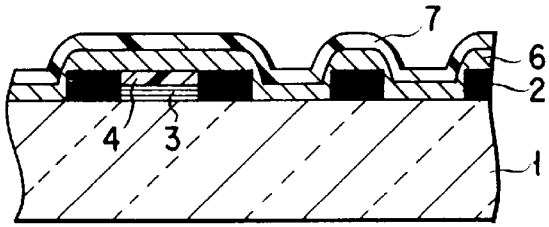
FIG. 3B
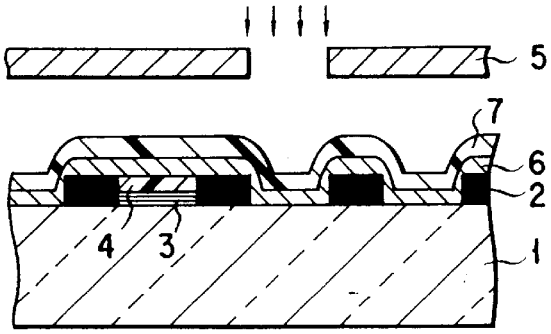
FIG. 3C
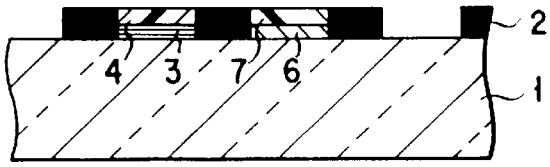
FIG. 3D

CATHODE RAY TUBE WITH COLOR FILTER

This is a division of application Ser. No. 08/936,516, filed Sep. 24, 1997, now U.S. Pat. No. 5,955,226 which is a continuation of Ser. No. 08/577,876, filed Dec. 22, 1995, now abandoned.

BACKGROUND OF THE INVENTION

1. Field of the Invention

The present invention relates to a display screen having color filters and a method of manufacturing the display screen. The present invention also relates to a cathode ray tube using this display screen.

2. Description of the Related Art

Red, blue, and green phosphor layers as dots or stripes are formed on the inner surface of a faceplate of a display device such as a cathode ray tube or a color television receiver. When electron beams are bombarded against the phosphor layers, the phosphor layers emit light to display an image.

In such a display device, phosphor layers have been conventionally studied to improve the image display characteristics such as a contrast and a color purity. For example, phosphor layers with filters are available in which pigment layers having the same colors as the emission colors of the phosphor layers are formed between a faceplate and the phosphor layers.

When the phosphor layers with filters are used in a display device, the red, blue, and green pigments selectively absorb the blue light component, the green light component, and blue and red light components, respectively. Therefore, the contrast and color purity of the display device are improved.

A method of manufacturing the phosphor layers with filters is disclosed in Jpn. Pat. Appln. KOKAI Publication No. 5-275008. According to this prior art, a substrate is coated with a resist, and a region except for predetermined positions on the substrate is exposed with light to form a resist pattern on the substrate. The resist pattern is coated with a pigment solution, and the resist pattern and the pigment layer on the resist pattern are removed by acid decomposition to form a pigment pattern at the predetermined positions, thereby obtaining a pigment layer of each color.

Another method of forming a pigment layer is disclosed in, e.g., Jpn. Pat. Appln. KOKAI Publication No. 5-275007. A substrate is coated with a pigment dispersion obtained by mixing an aqueous polymer such as polyvinyl alcohol (PVA) or polyvinyl pyrrolidone (PVP) with a crosslinking agent such as ammonium dichromate (ADC) or diazonium salt, and exposure and development with warm water are performed, thereby forming a pigment layer having a predetermined pattern.

In the above patterning, however, a patterning process consisting of exposure and development must be repeated three times to obtain, e.g., pigment layers of three colors. The number of steps in the manufacture undesirably increases. Strong demand has arisen for developing a method of more easily forming a filter pattern.

The red pigment layer is good in absorbency of ultra violet among three primary colors of pigments.

In, e.g., Jpn. Pat. Appln. KOKAI Publication No. 5-275007, it is difficult to form a red pigment layer consisting of one of pigments of three primaries by patterning process comprising exposure and development since ultra violet is absorbed by the red pigment layer so that a resist cannot be harden sufficiently.

SUMMARY OF THE INVENTION

The present invention has been made to improve the disadvantages of the conventional techniques, and has as its object to provide a display screen having a filter pattern formed with high precision in a simple process.

It is another object of the present invention to provide a cathode ray tube which uses an excellent display screen formed in the simple process and is excellent in contrast and brightness.

According to the first aspect of the present invention, there is provided a display screen comprising a substrate, a black matrix having a plurality of holes as circular or rectangular dots or stripes, first pigment layers optionally formed in the holes, and a second pigment layer formed on the substrate in a region except for a region in which the first pigment layers are formed.

According to the second aspect of the present invention, there is provided a method of manufacturing a display screen, comprising the steps of: coating a substrate having a black matrix having holes as circular or rectangular dots or stripes with a first pigment solution containing first pigment particles, and drying the first pigment solution to form a first pigment solution coating film; coating the first pigment solution coating film with a photoresist solution, and drying the resist solution to form a resist film; exposing and developing the first pigment solution coating film and the resist film to optionally form a first pigment layer pattern and a resist layer pattern in holes in which the first pigment layers are to be formed, respectively; coating the substrate with a solution containing second pigment particles, and drying the solution to form a second pigment layer; and applying a resist decomposition agent to the second pigment layer to decompose the resist layer pattern and remove the second pigment layer formed on the resist layer pattern.

According to the third aspect of the present invention, there is provided a cathode ray tube comprising a display unit including a faceplate, a black matrix formed on the faceplate and having a plurality of holes as circular or rectangular dots or stripes, first pigment layers optionally formed in the holes, a second pigment layer formed on the substrate in a region except for a region in which the first pigment layers are formed, and phosphor layers formed on the first and second pigment layers to emit light components having wavelength ranges corresponding to colors of the first and second pigment layers.

The present invention comprises: the step of coating the substrate with the solution containing the first pigment particles and drying the solution, then coating the first pigment solution layer with the photoresist solution to form the resist layer, exposing and setting the first pigment solution layer and the resist layer in a predetermined pattern, and developing the predetermined pattern to form a multilayered pattern consisting of the first pigment layer pattern and the photoresist layer pattern; and the step of coating the substrate and the multilayered pattern with the solution containing the second pigment particles and drying the solution, and then applying a resist decomposition agent to the resultant structure to remove the resist layer pattern together with the second pigment layer formed on the resist layer pattern, thereby exposing the first pigment layers. According to this method, the second pigment layer can be patterned without exposure. For this reason, a predetermined pigment layer pattern can be accurately obtained in a simpler process than the conventional process. At the same time, color mixing between the pigment layers of different colors can be prevented.

When phosphor layers are formed on the resultant display screen, and the resultant structure is used as the display unit of a cathode ray tube, an image can be displayed with a high brightness level and a high contrast level.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 1 is a partially cutaway sectional view showing a display device using a display screen according to the present invention;

FIGS. 3A to 3D are sectional views for explaining the steps of forming a green pigment layer according to the method of the present invention;

DETAILED DESCRIPTION OF THE PREFERRED EMBODIMENTS

Figure 2A:
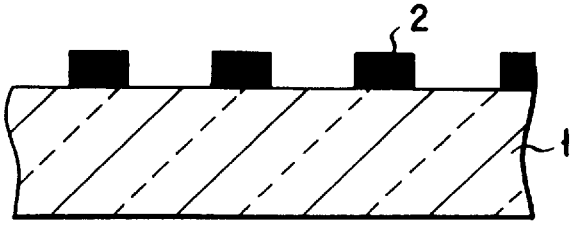
FIGS. 2A to 2E are sectional views for explaining the steps of forming a blue pigment layer according to the method of the present invention.
Figure 2B:
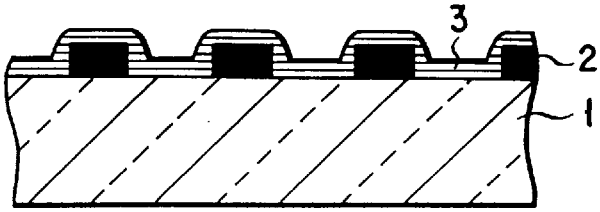

A display screen according to the present invention includes at least a substrate, a black matrix having a plurality of holes as circular or rectangular dots or stripes formed on the substrate, first pigment layers, and a second pigment layer. The first pigment layers are optionally formed in some holes in which the first pigment layers are to be formed. The second pigment layer is formed on the black matrix and in some holes in which the second pigment layer is to be formed.

When the display screen of the present invention is viewed from the substrate side, the second pigment layer formed on the black matrix cannot be seen because it is shielded by the black matrix. The respective pigment layers are seen to be formed as circular or rectangular dots or stripes in the black matrix.

In addition to the first pigment layers, a plurality of pigment layers having colors different from the colors of the first pigment layers may be formed in the plurality of holes of the black stripe. Adjacent pigment layers such as the first and second pigment layers when viewed from the substrate side generally have different colors.

The display screen described above can be manufactured by the following method of the present invention.

In the method according to the second aspect of the present invention, the first pigment layer and the resist layer are stacked on each other, exposed, and developed to form a multilayered pattern consisting of a first pigment layer pattern and a resist layer pattern in predetermined holes of the black matrix.

The second pigment layer is formed on the substrate on which the multilayered pattern is formed. The second pigment layer is coated with a resist decomposition agent. This resist decomposition agent reaches, through the second pigment layer, the resist layer pattern formed under the second pigment layer. The resist layer pattern is decomposed, and the second pigment layer formed on the resist layer pattern is removed, thereby exposing the first pigment layers.

The resultant display screen comprises a substrate, a black matrix formed on the substrate, first pigment layers formed in holes of the black matrix layer, and a second pigment layer formed in a region except for a region in which the first pigment layers are formed.

The region except for the region in which the first pigment layers are formed consists of an entire region on the black matrix and holes in which the first pigment layers are not formed. When the display screen is viewed from the substrate side, the second pigment layer formed on the black matrix is not seen because this layer is shielded by the black matrix. For this reason, no adverse influence is caused, and the first or second pigment layer is seen to be formed in each hole of the black matrix.

According to the present invention, after the substrate is coated with the solution containing the second pigment particles, and the solution is dried, this coating film need not be exposed into a predetermined pattern. When the resist layer pattern is removed by the resist decomposition agent, the first and second pigment layers can be finished. When the substrate is coated with a solution containing pigment particles of a given color, an already formed pigment layer of another color is protected by the resist layer pattern, and finally the cause of the color mixing are removed together with the resist layer pattern. Therefore, color mixing between different colors can be prevented.

Note that first pigment layers may include a plurality of pigment layers having different colors as well as a plurality of pigment layers having a single color. Pigment layers having a plurality of colors are formed by repeating coating, exposure, and development for each color.

According to the conventional method, to form pigment layers having a plurality of colors, e.g., three colors in holes at predetermined positions, exposure and development are repeated in units of colors, i.e., three times. According to the method of the present invention, however, exposure for the coating film of the third color need not be performed. According to the method of the present invention, the substrate is coated with the resist decomposition agent upon coating of the third color, and the resist layer pattern and the unnecessary portion of the pigment layer of the third color are removed altogether.

According to the present invention, resist coating and exposure can be omitted from patterning of the pigment layer to be formed last.

According to the third aspect of the present invention, phosphor layers having emission colors identical to the colors of the pigment layers of the display screen of the first aspect are formed on the pigment layers, respectively, thereby providing a cathode ray tube having this display screen as a display unit.

A conventional method can be used as a method of forming the phosphor layers.

For example, a phosphor slurry containing phosphor particles and a photosensitive resin is prepared, the substrate is coated with the phosphor slurry in the form of a pigment layer, and the phosphor slurry is dried to form a coating film.

Predetermined positions of the coating film are exposed and developed through, e.g., a shadow mask to form phosphor layers. The phosphor layers are generally formed in units of colors, and the above process is repeated the number of times corresponding to the number of colors of the pigment layers.

For example, phosphor layers with filters are formed on a color cathode ray tube panel by the following procedures.

The inner surface of a faceplate which has a black matrix is coated with the first pigment dispersion, and the first pigment dispersion is dried. At this time, the inner surface of the faceplate is coated with the dispersion such that the inner surface faces upward, laterally, or downward. Parameters such as the solid content, viscosity, and coating method of the pigment dispersion are variously selected to control coating of the faceplate with the pigment dispersion so as to achieve uniform coating. The most preferable coating method is a spin-coating method to obtain a uniform coating film having a predetermined thickness. A dipping method, a flow coating method, or the like can be used in place of the spin-coating method. The drying method can use shake-off drying, drying with a heater, drying with warm air, drying with dry air, natural drying at room temperature, or a combination thereof to form a pigment layer.

The pigment layer is then coated with a photoresist solution, and the photoresist solution is dried in the same manner as the pigment dispersion to form a multilayered structure consisting of a resist layer and a pigment layer. The multilayered structure is exposed with, e.g., a high-pressure mercury lamp, into a desired pattern through a shadow mask to perform development. The above operations are repeated for each color corresponding to the first colors. The inner surface of the faceplate is coated with the second pigment dispersion, this dispersion is dried, and predetermined treatment is performed with a resist decomposition agent to remove the resist pattern, thereby finishing the first and second pigment layers. To further form phosphor layers, phosphor dispersions are used in place of the pigment dispersions following the same procedures as in the first pigment layers.

A color cathode ray tube panel having the phosphor layers with filters can be used in a color cathode ray tube having the arrangement shown in FIG. 1.

FIG. 1 illustrates an example of the display apparatus according to the present invention, and is a partial cutaway side view showing a cathode ray tube manufactured on the basis of the invention. A cathode ray tube 60 has an airtight glass envelope 61 the interior of which is evacuated. The envelope 61 has a neck 62 and a cone 63 continuously extending from the neck 62. In addition, the envelope 61 has a faceplate 64 sealed by a frit glass. An explosion-proof tension band 65 consisting of a metal is wound around the periphery of the side wall of the faceplate 64. An electron gun 66 for emitting electron beams is arranged in the neck 62. A phosphor screen 67 is formed on the inner surface of the face plate 64. The phosphor screen 67 is constituted by a phosphor layer which is excited by electron beams from the electron gun 66 to emit light and a pigment layer formed between the phosphor layer and the inner surface of the face plate 64. A deflection unit (not shown) is arranged outside the cone 63. The pigment layer is obtained by the above process.

Any organic and inorganic pigments can be used as the pigments of the present invention. In particular, a pigment which can be uniformly dispersed in a filter layer, is free from light scattering, and provides a highly transparent filter layer is preferable. The particle size of the preferable pigment is 1 $\mu$m or less.

Examples of the pigments are as follows.

Examples of the inorganic red pigment are Sicotrans Red L-2817 (tradename; particle size: 0.01 to 0.02 $\mu$; available from BASF) as a ferric oxide pigment, and Chlomofartal Red A2B (tradename; particle size: 0.01 $\mu$m; available from Ciba-Geigy) as an anthraquinone pigment. Examples of the inorganic blue pigment are Cobalt Blue X (tradename; particle size: 0.01 to 0.02 $\mu$m; available from Toyo Ganryo) as a cobalt aluminate ($Al_2O_3$—CoO) pigment, Ultramarine No. 8000 (tradename; particle size: 0.3 $\mu$m; available from Daiichi Kasei) as an ultramarine pigment, and Lionol Blue FG-7370 (tradename; particle size: 0.01 $\mu$m; available from Toyo Ink) as a phothalocyanine blue pigment. Examples of the inorganic green pigment are Daipyroxide TM-Green #3320 (tradename; particle size: 0.01 to 0.02 $\mu$m; available from DAINICHISEIKA COLOUR & CHEMICALS MFG. CO., LTD.) as a $TiO_2$—NiO—CoO—ZnO pigment, Dipyroxide TM-green #3340 (tradename; particle size: 0.01 to 0.02 $\mu$m; available from DAINICHISEIKA COLOUR & CHEMICALS MFG. CO., LTD.) as a CoO—$Al_2O_3$—$Cr_2O_3$—$TiO_2$ pigment, Dipyroxide TM-green #3420 (tradename; particle size: 0.01 to 0.02 $\mu$m; available from DAINICHISEIKA COLOUR & CHEMICALS MFG. CO., LTD.) as a CoO—$Al_2O_3$—$Cr_2O_3$ pigment, ND-801 (tradename; particle size: 0.35 $\mu$m; available from Nippon Denko) as a $Cr_2O_3$ pigment, Fastgen Green S (tradename; particle size: 0.01 $\mu$m; available from DAINIPPON INK & CHEMICALS, INC.) as a chlorinated phthalocyanine green pigment, and Fastgen Green 2YK (tradename; particle size: 0.01 $\mu$m; available from DAINIPPON INK & CHEMICALS, INC.) as a brominated phthalocyanine green pigment.

An example of the organic red pigment is Lake Red C (tradename; available from DAINICHISEIKA COLOUR & CHEMICALS MFG. CO., LTD.) serving as an azolake pigment. An example of the organic blue pigment is Fastgen Blue GNPS (tradename; available from DAINIPPON INK & CHEMICALS, INC.) serving as copper-phthalocyanine pigment. An example of the organic green pigment is Lionol Green 2Y-301 (tradename; available from Toyo Ink) serving as a chlorinated and brominated copper-phthalocyanine pigment.

Such a pigment can be mixed and stirred with a dispersant for dispersing the pigment and distilled water to obtain a dispersion for forming a pigment layer. Note 10 wt % or less of an aqueous organic solvent such as alcohol can be contained in distilled water.

Examples of the dispersant are an anionic sodium salt dispersant, an anionic ammonium salt dispersant, and a nonionic dispersant. Examples of the anionic sodium salt dispersant are an acrylic dispersant, an acryl-styrene dispersant, an acrylic copolymer, a polycarboxylic acid dispersant, and formalin naphthalenesulfonate condensate. An example of the acrylic dispersant is Dispec N-40 (available from Allied Colloid). Examples of the polycarboxylic acid polymer dispersant are Demol EP (available from Kao Corp.) and Poise 520 (available from Kao Corp.) An example of the formalin naphthalenesulfonate condensate is Demol N (available from Kao Corp.) Examples of the special aromatic formalin sulfonate condensate and the octylphosphate monoethanol amino salt are Demol (available from Kao Corp.) and Elenon No. 19, respectively. Examples of the anionic ammonium salt dispersant are an acrylic dispersant, an acryl-styrene dispersant, an acrylic copolymer, a polycarboxylic acid dispersant, and polyoxyethylenealkylethersulfate. An example of the acrylic dispersant is Dispec A-40 (available from Allied Colloid). An example of the polycarboxylic acid polymer dispersant is Discoat N-14 (available from Dai-ichi Kogyo Seiyaku Co., Ltd.) An example of the ammonium salt of polyoxyethylenealkylethersulfate is Hytenol 08 (available from Dai-ichi Kogyo Seiyaku Co., Ltd.) An example of the condensed naphthalenesulfonic acid is Lomer PWA (available from Sun Nobco). Examples of the nonionic dispersant are polyoxyethylenelauriether, a polyoxyethylene derivative, polyoxyalkylenealkylether, polyoxyethylenenonylphenylether, and polyoxyethylenesorbitanmonolaurate. Examples are Noigen EA-140 (available from Dai-ichi Kogyo Seiyaku Co., Ltd.), Emulgen 106 (available from Kao Corp.), and Leodol TW-L120 (available from Kao Corp.)

The content of a pigment dispersed in a dispersant may falls within the range of 0.1 wt % to 50 wt %, and preferably 1 wt % to 50 wt %. If the pigment content is less than 1 wt %, a pigment layer does not tend to exhibit any color. When the pigment content exceeds 1 wt %, coloring can be clearly observed. When the pigment content exceeds 50 wt %, the viscosity of the corresponding dispersant tends to be abruptly increased. As a result, a uniform film may not be formed.

Warm water is preferably used as a developing agent used in developing a pigment layer.

The photoresist solution in the present invention can be obtained by mixing a photoresist and an additive (e.g., an acrylic emulsion and a surfactant) with distilled water. Various aqueous photoresists such as ammonium dichromate (ADC)/polyvinyl alcohol (PVA), sodium dichromate (SDC)/PVA, diazonium salt/PVA, and ADC/casein can be preferably used as the photoresist.

A combination of a first solution consisting of acids and a second solution consisting of a peroxide can be used as the resist decomposition agent used in the present invention. After a solution of acids is applied, a peroxide solution can be applied, or these solutions two solutions can be mixed and used. The first solution can be selected from sulfamic acid, sulfuric acid, nitric acid, and the like. The second solution can be selected from potassium permanganate, potassium periodate, and the like.

The latter material has a function of decomposing a resist layer and a pigment layer. The former material acts on especially a dispersant in a pigment layer and is hardened to inhibit the decomposition action of the latter material. By the action of these two materials, only the resist pattern and the pigment layer formed thereon are decomposed, thereby finishing the pattern. When the concentration of the former material is excessively low, or the concentration of the latter is excessively high, all the pigment layers tend to be removed, and no pattern tends to be formed. When the concentration of the latter is excessively low, the resist tends to be not removed, resulting in a mixing failure. The same effect as described above can be obtained in a separation method in which batch treatment with a solution mixture is not performed, but treatment with the resist decomposition agent as the latter material is performed after only the former solution is applied and hardened.

Note that preferable combinations each consisting of a dispersant and a resist decomposition agent is such as anionic polymer dispersant and one of the above resist decomposition agent.

The present invention will be described in detail with reference to the accompanying drawings, in which the first pigment layers are blue and green pigment layers and the second pigment layer is a red pigment layer.

FIGS. 2A to 4C are sectional views showing the steps to explain a method of the present-invention. As shown in FIG. 2A, a predetermined light-absorbing layer pattern 2 is formed on a substrate 1 consisting of, e.g., glass.

Pigment dispersions and a photoresist solution for forming blue, green, and red filters were prepared to have the following compositions.

| Blue Pigment Dispersion | |
|---|---|
| Blue pigment particles: cobalt aluminate (tradename: Cobalt Blue X (particle size: 0.01 to 0.2 μm; available from Toyo Ganryo)) | 30 wt % |
| Dispersant: ammonium salt of polyacrylic copolymer (Dispec Ga-40 (available from Allied Colloid) | 0.7 wt % |

These two materials were dispersed in distilled water.

| Green Pigment Dispersion | |
|---|---|
| Green pigment particles: $TiO_2$—NiO—CoO—ZnO (tradename: Dipyroxide TM-Green #3320 (particle size: 0.01 to 0.02 μm; available from DAINICHISEIKA COLOUR & CHEMICALS MFG. CO., LTD.)) | 30 wt % |
| Dispersant: sodium salt of acrylic acid (Dispec N-40) | 0.7 wt % |

These two materials were dispersed in distilled water.

| Red Pigment Dispersion | |
|---|---|
| Red pigment particles: fine particles of $Fe_2O_3$ (particle size: 0.01 to 0.02 μm) | 20 wt % |
| Dispersant: ammonium salt of polyoxyethylenealkylethersulfate (Hytenol 08 (available from Dai-ichi Kogyo Seiyaku Co., Ltd.)) | 0.7 wt % |

These two materials were dispersed in distilled water.

| Photoresist Solution | |
|---|---|
| Polyvinyl alcohol | 3 wt % |
| Ammonium dichromate | 0.20 wt % |
| Surfactant | 0.01 wt % |
| Distilled water | balance |

The substrate 1 was kept at a temperature of 30° C., and coated with the pigment dispersion for a blue pigment layer 3. The substrate 1 was rotated at 100 to 300 rpm to shake off the excessive pigment dispersion. The resultant substrate was dried at a heater temperature of 120° C. for 3 to 4 minutes.

Figure 2C:
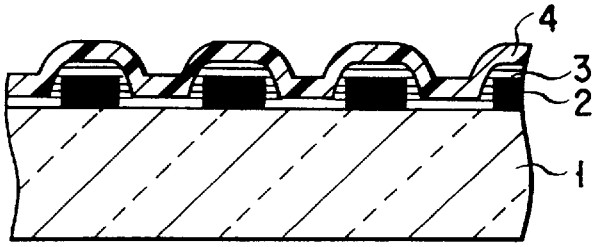

The resultant structure was then coated with the photoresist solution, and this solution was dried, thereby obtaining a multilayered structure consisting of a resist layer 4 and the blue pigment layer 3, as shown in FIG. 2C.

Figure 2D:
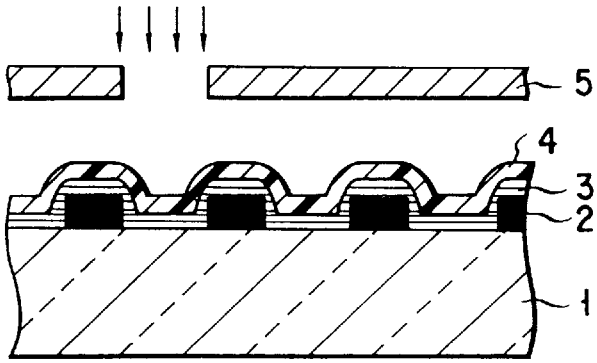

The multilayered structure was exposed into a predetermined pattern with a high-pressure mercury lamp through, e.g., a color discrimination electrode 5, as shown in FIG. 2D.

Figure 2E:
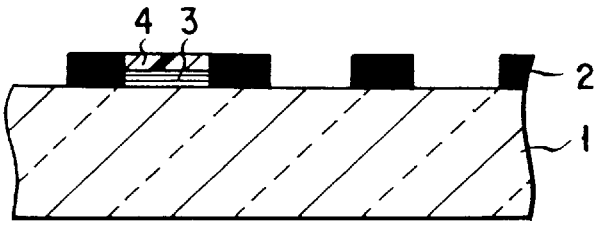

A water spray, for example, was sprayed at a water pressure of 2 to 10 kg/cm$^2$ to form a multilayered pattern consisting of the resist layer 4 and the blue pigment layer 3, as shown in FIG. 2E.

As shown in FIG. 3A, the substrate 1 was kept at a temperature of 30° C. and coated with the pigment dispersion for a green pigment layer 6, as shown in FIG. 3A. The substrate 1 was rotated at 100 to 300 rpm to shake off the excessive pigment dispersion. The resultant substrate was dried at a heater temperature of 120° C. for 3 to 4 minutes.

The resultant structure was then coated with the photoresist solution, and this solution was dried, thereby obtaining a multilayered structure consisting of a resist layer 7 and the green pigment layer 6, as shown in FIG. 3B.

The multilayered structure was exposed into a predetermined pattern with a high-pressure mercury lamp through, e.g., the color discrimination electrode 5, as shown in FIG. 3C.

A water spray, for example, was sprayed at a water pressure of 2 to 10 kg/cm$^2$ to form a multilayered pattern consisting of the resist layer 7 and the green pigment layer 6, as shown in FIG. 3D.

The substrate 1 was kept at a temperature of 30° C., and a multilayered pattern consisting of the substrate 1, the resist layers 4 and 7, and the blue or green pigment layer 3 or 6 was coated with the pigment dispersion for a red pigment layer 8. The substrate 1 was rotated at 100 to 300 rpm to shake off the excessive pigment dispersion. The resultant substrate was dried at a heater temperature of 120° C. for 3 to 4 minutes.

Figure 4A:
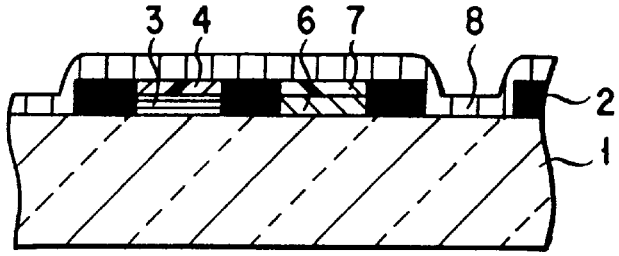
FIGS. 4A to 4C are sectional views for explaining the steps of forming a red pigment layer according to the method of the present invention.
Figure 4B:
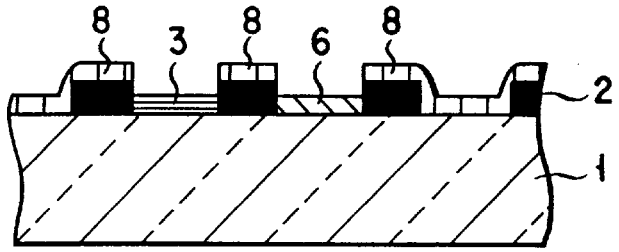

A resist decomposition solution as an aqueous solution of, e.g., 5% of sulfamic acid and 0.5% of potassium periodate was sprayed on the pigment layers to remove the resist layers 4 and 7 together with the red pigment layer formed on the resist layers 4 and 7. As shown in FIG. 4B, pigment layers consisting of the blue, green, and red pigment layers 3, 6, and 8 on the substrate 1 were obtained.

Figure 5:
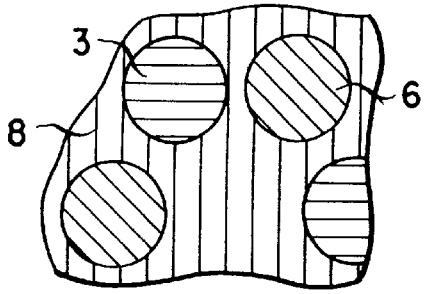
FIG. 5 is a plan view of pigment layers formed on the display screen of the present invention.

In the resultant pigment layers, the red pigment layer 8 was perfectly removed from the blue and green pigment layers 3 and 6 by the removal treatment. As shown in FIG. 5, the red pigment layer 8 covered the entire region of the substrate 1 except for the portions where the blue and green pigment layers 3 and 6 were located.

Exposure was not required in forming the last red pigment layer 8, and the filter manufacturing process could be simplified. In coating the substrate with the pigment dispersion for the green pigment layer 6, the resist layer 4 covered the blue pigment layer 3. In coating the substrate with the pigment dispersion for the red pigment layer 8, the resist layers 4 and 7 covered the blue and green pigment layers 3 and 6. The resist layers 4 and 7 were finally removed, thereby preventing color mixing between blue, green, and red.

Figure 4C:
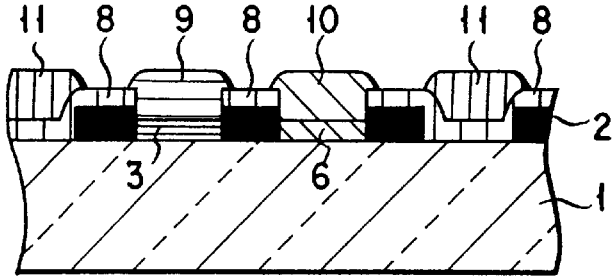

Blue, green, and red phosphor layers 9, 10, and 11 were formed in correspondence with the blue, green, and red pigment layers 3, 6, and 8 by the conventional method, as shown in FIG. 4C.

As described above, the phosphor layers with desired filters, in which the pigment and phosphor layers are formed on the substrate are obtained, and the contrast and color purity of a color cathode ray tube using these phosphor layers are improved. According to the present invention, the second pigment layer is not left as a residue on the first pigment layers, and the first pigment layers are not, of course, left on the second pigment layer. These pigment layers are free from color mixing and serve as filters excellent in color purity characteristics.

In this embodiment, the same effect as described above can be obtained even if 0.3% of potassium periodate are applied to the substrate to perform the removal process of the resist layers 4 and 7 after 3% of sulfamic acid are applied to the substrate.

In the above embodiment, the first pigment layers are blue and green pigment layers, and the second pigment layer is a red pigment layer. However, the second pigment layer may be one of the blue and green pigment layers. In particular, the red pigment layer has a high ultraviolet absorbance, and insufficient exposure caused by a combination of the red pigment layer and a resist results in insufficient hardening of the resist.

According to the present invention, since the red pigment layer is formed last without using a resist, defects caused by errors of the red pigment layer caused by using the resist can be prevented.

A method of forming pigment layers according to the present invention is easily applicable to, e.g., a color filter for a liquid crystal display element.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A display screen having a color filter, the display screen comprising:

a substrate;

a black matrix formed on the substrate, the matrix including (i) a first main region covering the substrate and (ii) a second region defined by a plurality of holes in the first main region, the holes having shapes selected from the group comprising: circular dots, rectangular dots, and stripes;

a first pigment portion including a number of first color filter layers, each first color filter layer being one of a number of colors and respectively formed in at least one of the holes; and a second pigment portion including at least one final color filter layer of a final color, the at least one final color filter layer being continuously formed to entirely cover the first region and to be formed in at least another one of the holes.

2. A screen according to claim 1, wherein pigment particles used for the color filter layers have an average particle size of not more than 0.1 $\mu$m.

3. A cathode ray tube comprising:

a display unit including a faceplate;

a black matrix formed on the faceplate, the matrix including (i) a first main region covering the faceplate and (ii) a second region defined by a plurality of holes in the first main region, the holes having shapes selected from the group comprising: circular dots, rectangular dots, and stripes;

a first pigment portion including a number of first color filter layers, each first color filter layer being one of a number of colors and respectively formed in at least one of the holes; and a second pigment portion including at least one final color filter layer of a final color, the at least one final color filter layer being continuously formed to entirely cover the first region and to be formed in at least another one of the holes; and phosphor layers respectively formed on each of the color filter layers, each of the phosphor layers being adapted to emit light components having wavelength ranges corresponding to the color of the respective color filter layer.

4. A display screen having a color filter, the display screen comprising:

a substrate;

a black matrix formed on the substrate, the matrix including (i) a first main region covering the substrate and (ii) a second region defined by a plurality of holes in the first main region, the holes having shapes selected from the group comprising: circular dots, rectangular dots, and stripes;

a plurality of color filter layers, each layer being (i) one of at least two colors and (ii) respectively formed in at least one of the holes; and at least one other color filter layer of a final color, the at least one other color filter being continuously formed to entirely cover the first region and formed in at least another one of the holes.

5. A cathode ray tube comprising:

a display unit including a faceplate;

a black matrix formed on the faceplate, the matrix including (i) a first main region covering the faceplate and (ii) a second region defined by a plurality of holes formed in the first main region, the holes having shapes selected from the group comprising: circular dots, rectangular dots, and stripes;

a plurality of color filter layers, each layer being (i) one of at least two colors and (ii) respectively formed in at least one of the holes;

at least one other color filter layer of a final color, the at least one other color filter being continuously formed to entirely cover the first region and formed in at least another one of holes; and phosphor layers respectively formed on each of the color filter layers, each of the phosphor layers being adapted to emit light components having wavelength ranges corresponding to the color of the respective color filter layer.

* * * * *